US007861621B2

(12) United States Patent
Cheng

(10) Patent No.: US 7,861,621 B2
(45) Date of Patent: Jan. 4, 2011

(54) BOX END/OPEN END WRENCH

(76) Inventor: Chin-Shun Cheng, No. 37-2, Ching-Dau 1st Street, Taichung (TW) 40464

( * ) Notice: Subject to any disclaimer, the term of this patent is extended or adjusted under 35 U.S.C. 154(b) by 221 days.

(21) Appl. No.: 12/267,624

(22) Filed: Nov. 10, 2008

(65) Prior Publication Data

US 2010/0116099 A1 May 13, 2010

(51) Int. Cl.
*B25B 13/02* (2006.01)
*B25B 13/06* (2006.01)

(52) U.S. Cl. ..... 81/121.1; 81/125.1

(58) Field of Classification Search ..... 81/121.1, 81/119, 125.1, 186
See application file for complete search history.

(56) References Cited

U.S. PATENT DOCUMENTS 3,003,379 A * 10/1961 Pribitzer ..... 81/119
3,757,614 A * 9/1973 Evans et al. ..... 81/119
3,802,303 A * 4/1974 Evans et al. ..... 81/185
3,850,057 A * 11/1974 Evans ..... 81/119
3,905,255 A * 9/1975 Evans ..... 81/119
3,921,476 A * 11/1975 Evans ..... 81/119
3,931,749 A * 1/1976 Evans ..... 81/119
6,131,492 A * 10/2000 Mai ..... 81/119
6,269,715 B1 * 8/2001 Cagny ..... 81/119
6,289,772 B1 * 9/2001 Ying-Wen ..... 81/119
6,305,252 B1 * 10/2001 Hsu ..... 81/186
7,024,967 B1 * 4/2006 Cheng ..... 81/60
7,107,879 B1 * 9/2006 Cheng ..... 81/121.1

* cited by examiner

*Primary Examiner*—David B Thomas

(57) ABSTRACT

A driving head of a wrench includes three engaging surfaces and three reception concavities alternatively defined in an inner periphery thereof. A recess is defined in a center of each of engaging surfaces and located between first and second engaging portions. The last reception concavity has one of two insides connected to the second engaging portions next to it, the other insides of the last reception concavity is connected with a third engaging portion. The recesses and the reception concavities are sized to accommodate protrusions of a star-shaped nut. The reception concavity is sized to accommodate one of protrusions of a star-shaped nut. The adjacent first and second engaging portions have a common tangent line and three respective common tangent lines are located on three sides of a hexagonal object. The wrench is able to drive the object in two opposite directions without removing the wrench from the object.

10 Claims, 16 Drawing Sheets

BOX END/OPEN END WRENCH

FIELD OF THE INVENTION

The present invention relates to a hand tool, and particularly, to a wrench with a box end and/or an open end, and each end has a through hole composed of an engaging hole and an accommodating hole so as to repeatedly drive an object without removing the end from the object.

BACKGROUND OF THE INVENTION

A conventional wrench is disclosed in WO9838009 and includes an open end having multiple recesses E1 to E6 of different curvatures and engaging surfaces P1 to P7 which are located alternatively to the recesses. When driving a hexagonal object, three sides of the object are in contact with the engaging surfaces and the corers of the object are accommodated within the recesses as shown in FIGS. 4 to 7 of WO9838009. The wrench does not need to remove from the object while rotating the wrench to adjust a proper angular position to the stationary object. However, there are two different systems of the specifications of the objects, such as the Metric system using mini-meter, the English system using inches and even the Star workpiece which is cataloged by "E". For example, the 19 mm Hexagonal nut, the ⅔ inch Hexagonal nut and E24 star-shaped nut have slightly difference and are grouped together, the 18 mm Hexagonal nut, the 11/16 inch Hexagonal nut and E22 star-shaped nut have slightly difference and are grouped together, so that the user has to use specific wrench to correctly drive these similar nuts without taking the risk of rounding the corners of the nuts.

U.S. Pat. No. 7,107,879 discloses a box wrench assembly comprising a plurality of latch edges disposed around an internal periphery of an operating end of a wrench. Each of said latch edges comprises a protruded surface, a plurality of accommodating grooves, disposed sequentially with said latch edges, each accommodating groove being disposed between two of said latch edges, and a groove defined in said protruded surface of each of said latch edges. The groove comprises two lateral sides parallel with each other for firmly contacting two lateral sides of a square tooth of a fastener and for pinching two adjacent sides of an angle of a fastener. The patented wrench is able to drive objects of different sizes and shapes. However, the wrench has to be removed from the object so as to re-adjust the driving head of the wrench a proper position so as to mount onto the object again to output a torque to the object. This will prolong the operation time to tighten or loosen the object.

The present invention intends to provide a wrench having a box end and/or an open end, the box end and/or the open end includes a through hole which allows the user to rotate the wrench in two opposite direction without removing the wrench from the object.

SUMMARY OF THE INVENTION

The present invention relates to a wrench which comprises a driving head on one end of the wrench and the driving head has an engaging hole which includes three engaging surfaces and three reception concavities alternatively defined in an inner periphery thereof. Each engaging surface is located on a protruding and curved surface which extends toward a center of the engaging hole and each reception concavity includes two symmetric curved insides. The reception concavities each are able to accommodate one of protrusions of a star-shaped nut. A recess is defined in a center of each of engaging surfaces and extends parallel to the axis of the engaging hole. Each recess is located between a first engaging portion and a second engaging portion which is located symmetrically to the first engaging portion. The reception concavity located at the conjunction between the accommodating hole and the engaging hole has one of two insides thereof connected to the second engaging portions next to it, and the other insides of the reception concavity is located at the conjunction between the accommodating hole and the engaging hole connected with a third engaging portion which has an identical shape as the first engaging portion. Each recess includes two insides and a bottom is located between the two insides. A distance between the two insides is able to accommodate one of protrusions of a star-shaped nut. A curved surface is connected between the first/second engaging portion and the insides of each of the recesses, a smooth surface is connected between the first/second engaging portion and each of the reception concavities. A space between the smooth surface and the reception concavity is able to accommodate one of protrusions of a star-shaped nut. The adjacent first and second engaging portions have a common tangent line and three respective common tangent lines are located on three sides of a hexagonal object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
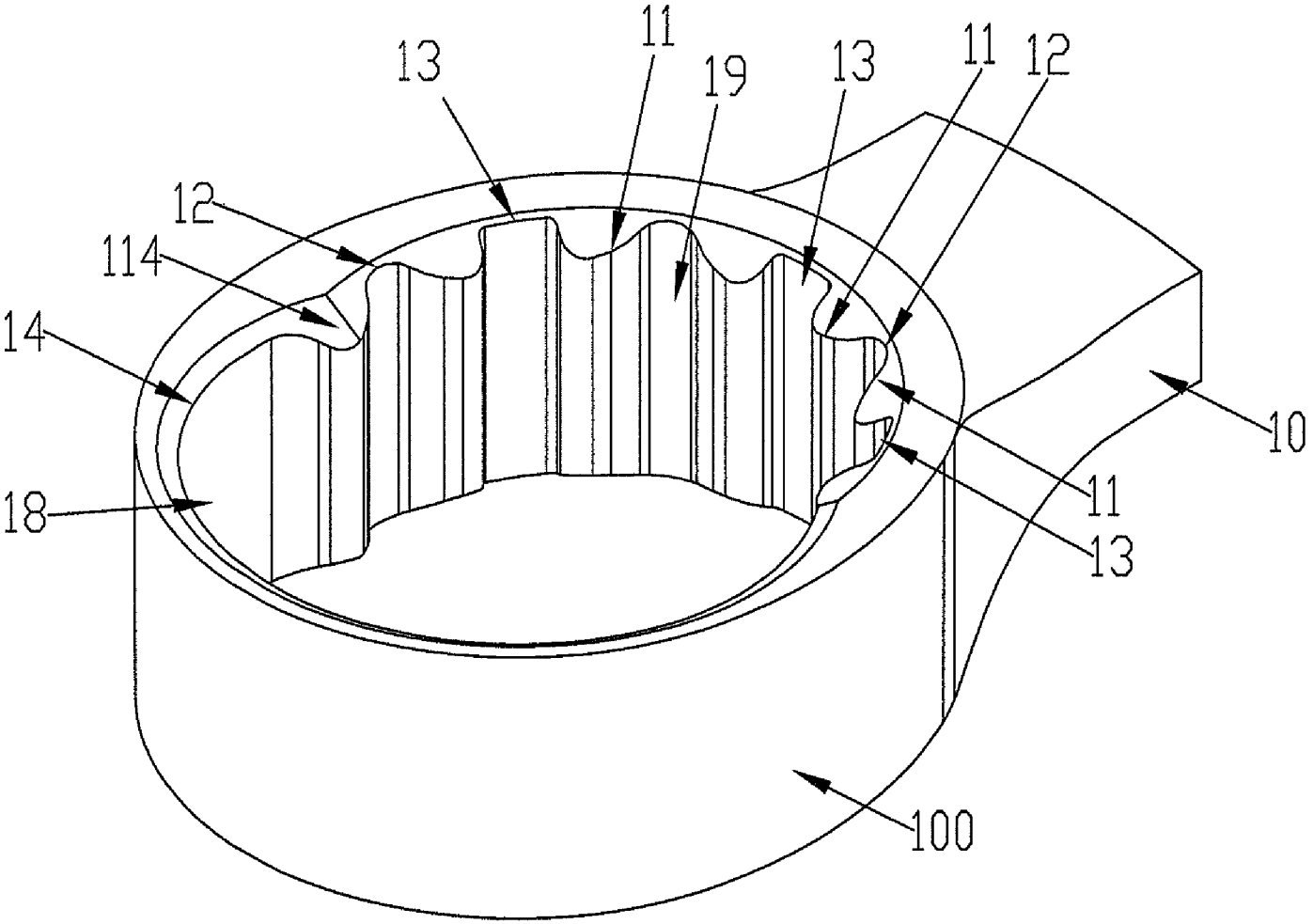
FIG. 1 is a perspective view to show the wrench of the present invention.
Figure 2:
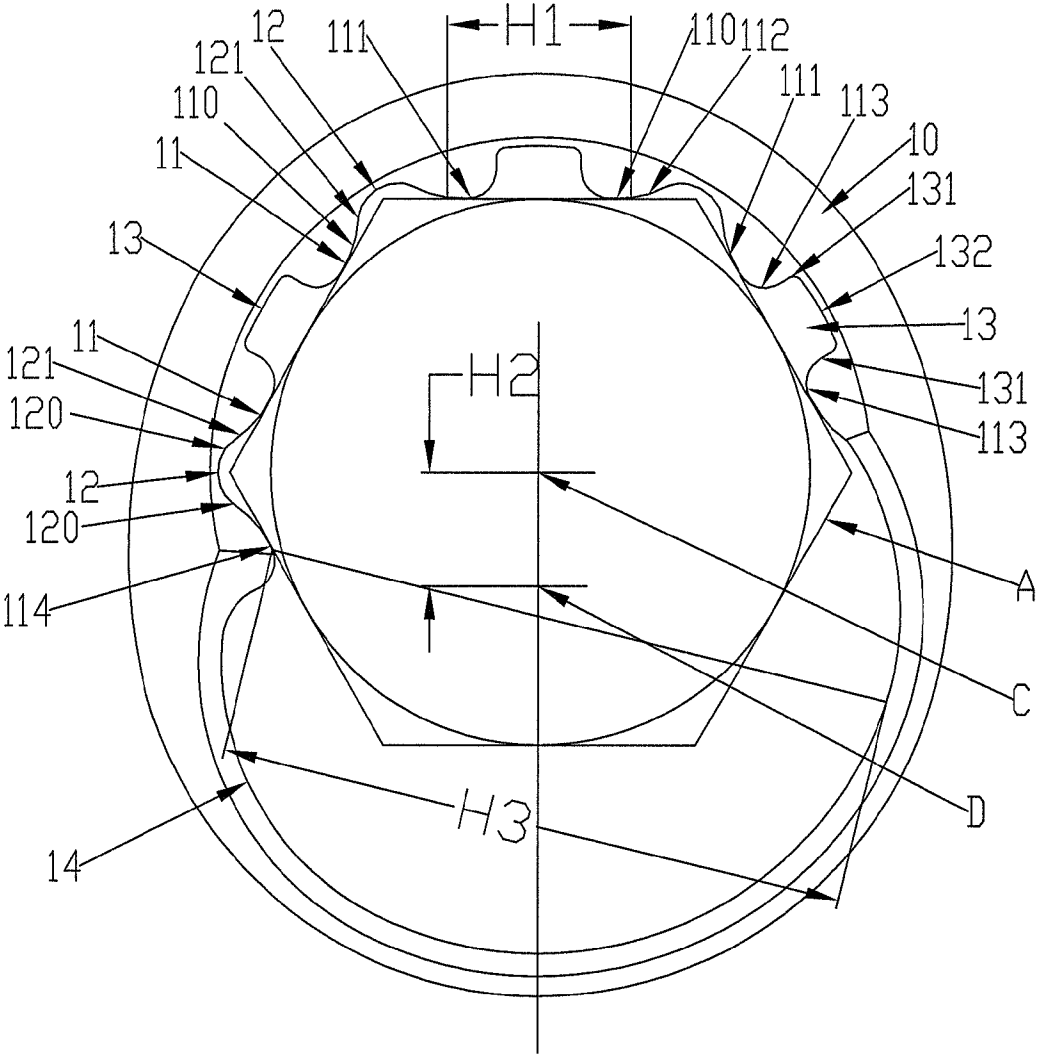
FIG. 2 shows the through hole of the driving head of the wrench of the present invention.
Figure 3:
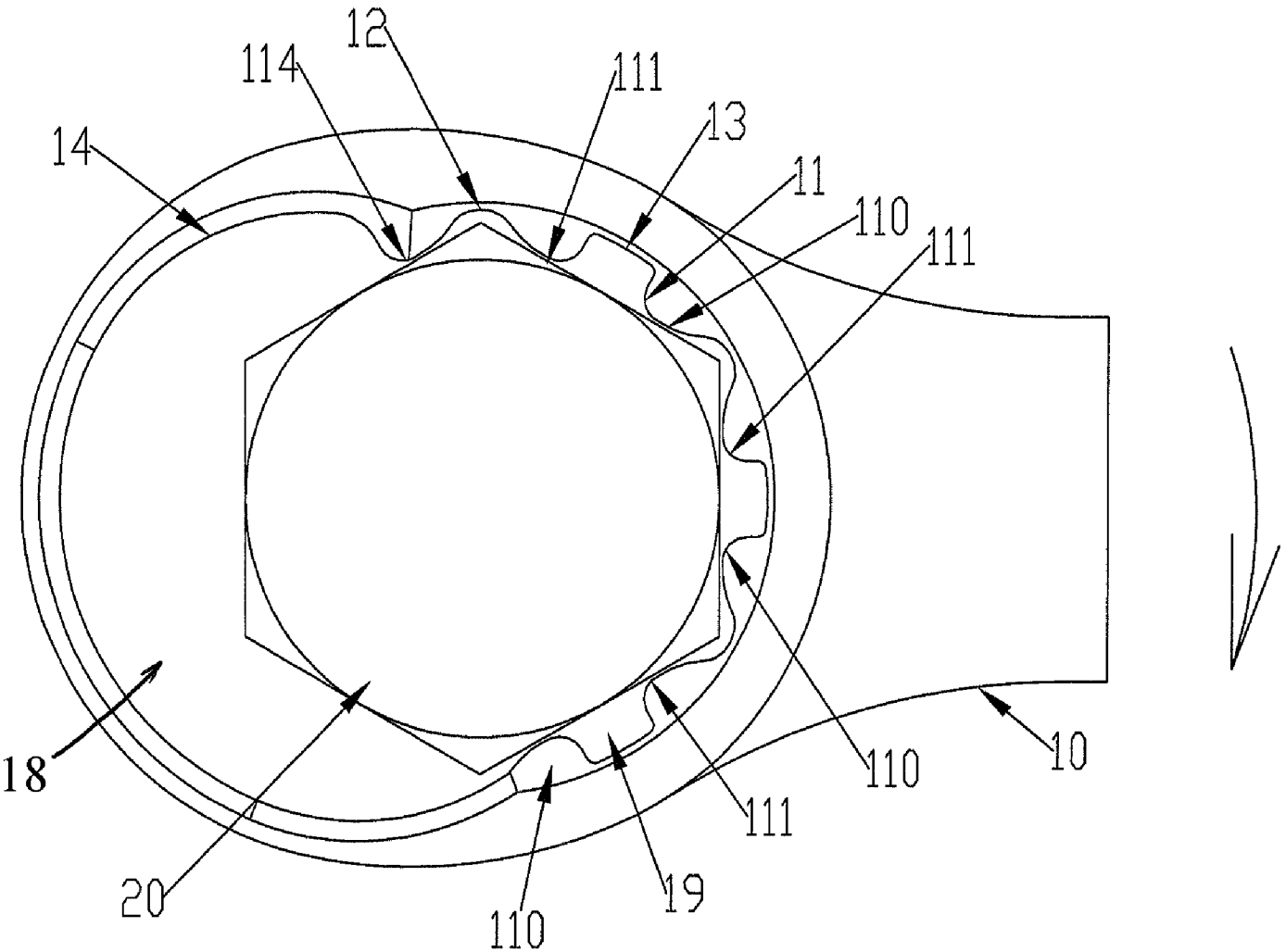
FIG. 3 shows that the wrench of the present invention driving a hexagonal object in one direction.

Referring to FIGS. 1 to 3, the wrench of the present invention comprises an elongate body 10 to be a handle having a first end and a second end, a driving head 100 is connected on the first end and includes a through hole 14 which is composed of an accommodating hole 18 and an engaging hole 19 which communicates with the accommodating hole 18.

The engaging hole 19 includes three engaging surfaces 11 and three reception concavities 12 defined in an inner periphery thereof and located about an axis of the engaging hole 19. The three engaging surfaces 11 are located alternatively to the three reception concavities 12. Each engaging surface 11 is located on a convex and curved surface extending toward a center of the engaging hole 19 and each reception concavity 12 includes two symmetric curved insides 120. The reception concavities 12 each are sized to accommodate one of protrusions 31 of a star-shaped nut 30. A recess 13 is defined in a center of each of engaging surfaces 11 and extends parallel to the axis of the engaging hole 19. The reception concavity 12 and the recess 13 are different in shape.

Each recess 13 is located between a first engaging portion 110 and a second engaging portion 111 which is located symmetrically to the first engaging portion 110. The reception concavity 12 is located at the conjunction between the accommodating hole 18 and the engaging hole 19 has one of two insides thereof connected to the second engaging portions 111 next to it, the other insides of the reception concavity 12 located at the conjunction between the accommodating hole 18 and the engaging hole 19 is connected with a third engaging portion 114 which has an identical shape as the first engaging portion 110. Each recess 13 includes two insides 131 and a bottom 132 is located between the two insides 131. The bottom 132 of each of the recesses 13 is a concaved and curved bottom. A rounded corner is defined at a conjunction between each of the two insides 131 and the bottom 132. A distance between the two insides 131 can accommodate one of protrusions 31 of a star-shaped nut 30. A curved surface 113 is connected between the first/second engaging portion 110/111 and the insides 131 of each of the recesses 13. A smooth surface 121 is connected between the first/second engaging portion 110/111 and each of the reception concavities 12. A space between the smooth surface 121 and the reception concavity 12 can accommodate one of protrusions 31 of a star-shaped nut 30. The adjacent first and second engaging portions 110, 111 have a common tangent line and three respective common tangent lines located on three sides of a hexagonal object "A". A distance defined between a center "C" of an inscribed circle and a center "D" of the accommodating hole 18. A maximum distance "H3" from the third engaging portion 114 to the accommodating hole 18 is larger than a maximum diagonal of the hexagonal object "A".

As shown in FIGS. 3-10, the engaging hole 19 of the driving head 100 can drive hexagonal objects 20, star-shaped objects 30, gear-shaped objects 40 and rectangular objects 50. The object can be shifted to the accommodating hole 18 so that the wrench can be freely rotated relative to the object which does not rotate with the wrench.

As shown in FIG. 3 when a hexagonal object 20 is engaged with the engaging hole 19, the first, second and third engaging portions 110, 111, 114 are in contact with the four sides of the object 20, the three corners of the object 20 are received in the reception concavities 12. The object 20 is co-rotated with the wrench in clockwise direction.

Figure 4:
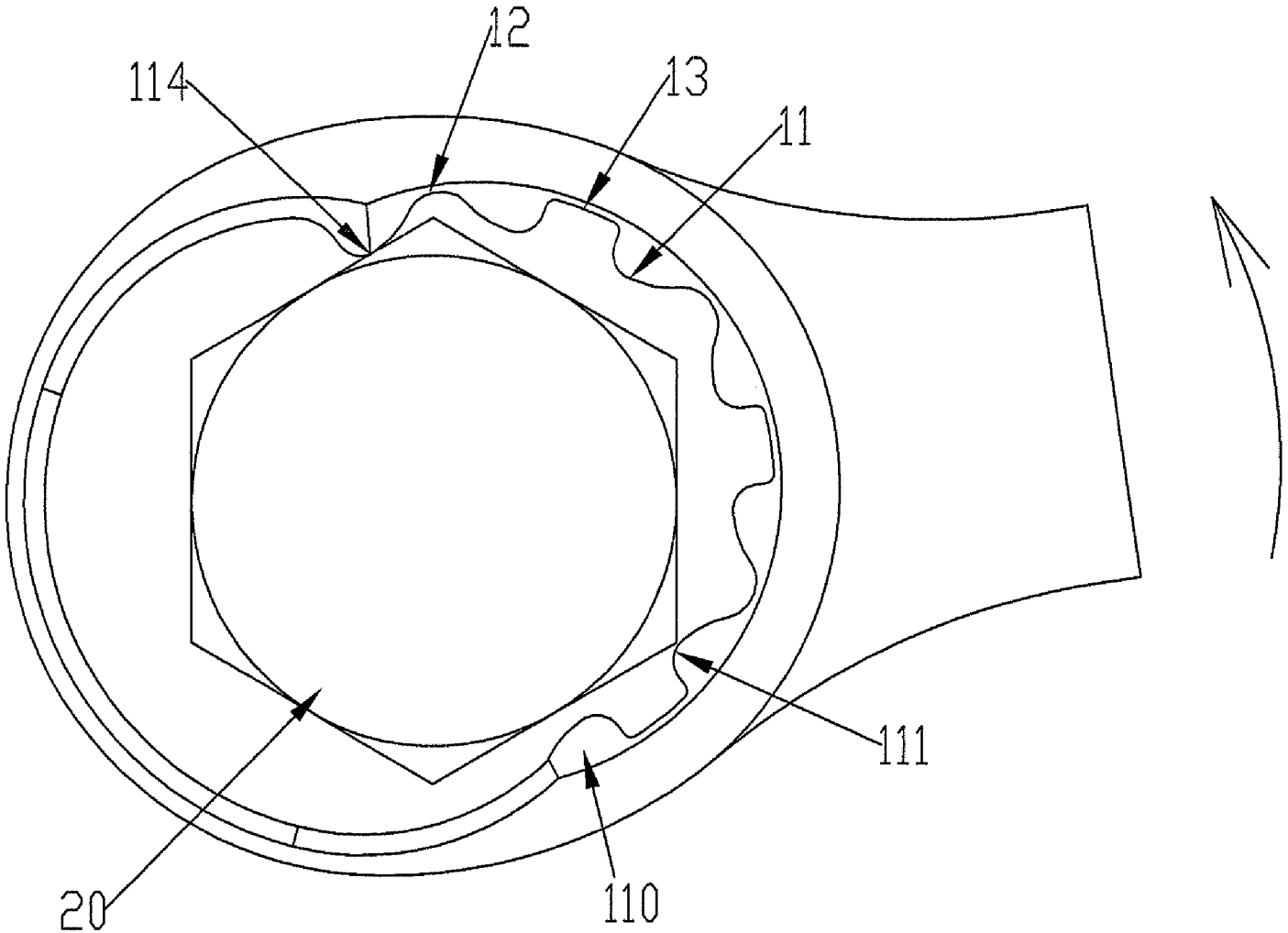
FIG. 4 shows that the wrench of the present invention rotates in opposite direction while the wrench does not remove from the hexagonal object.
Figure 5:
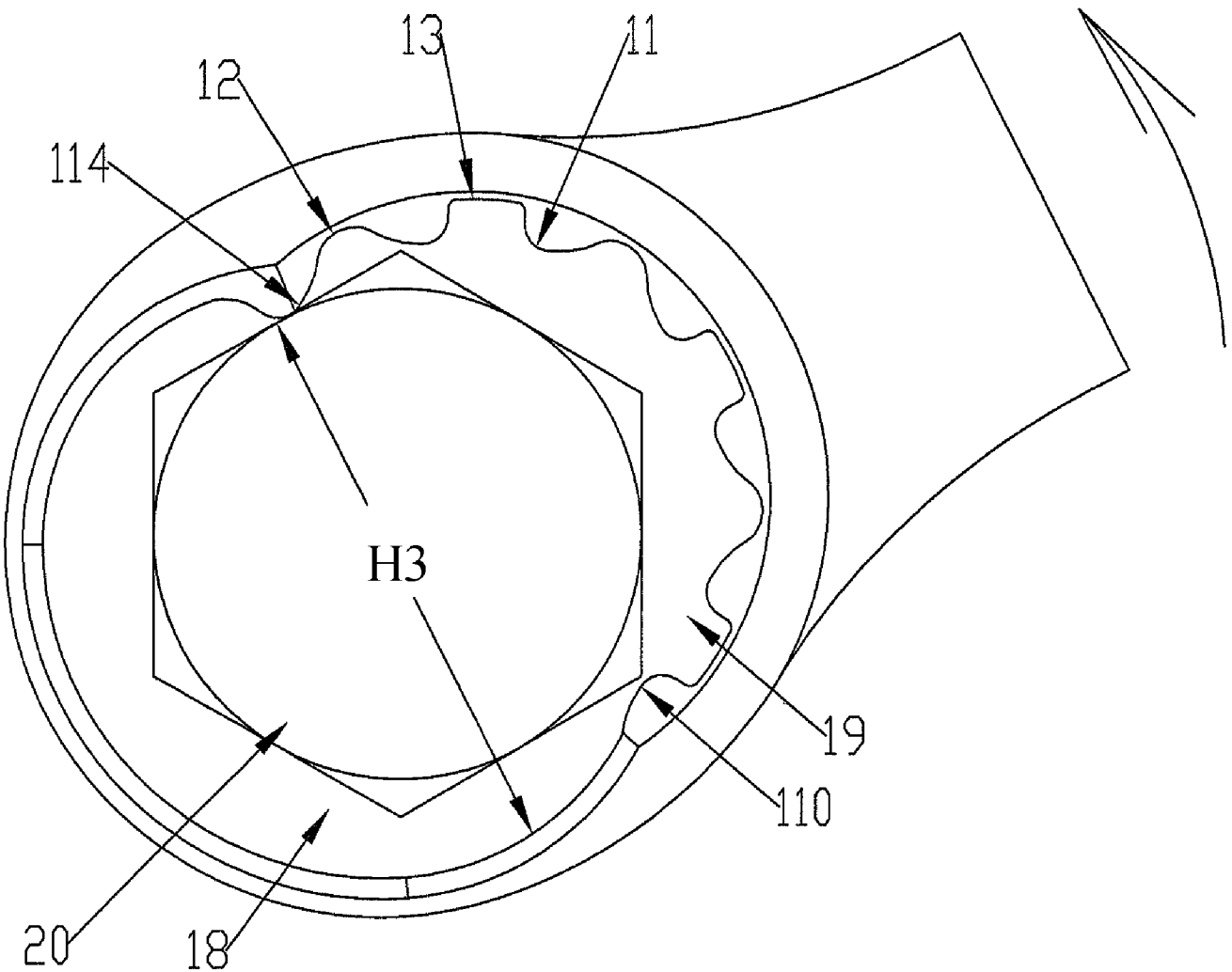
FIG. 5 shows another status of the wrench of the present invention rotating in opposite direction while the wrench does not remove from the hexagonal object.
Figure 6:
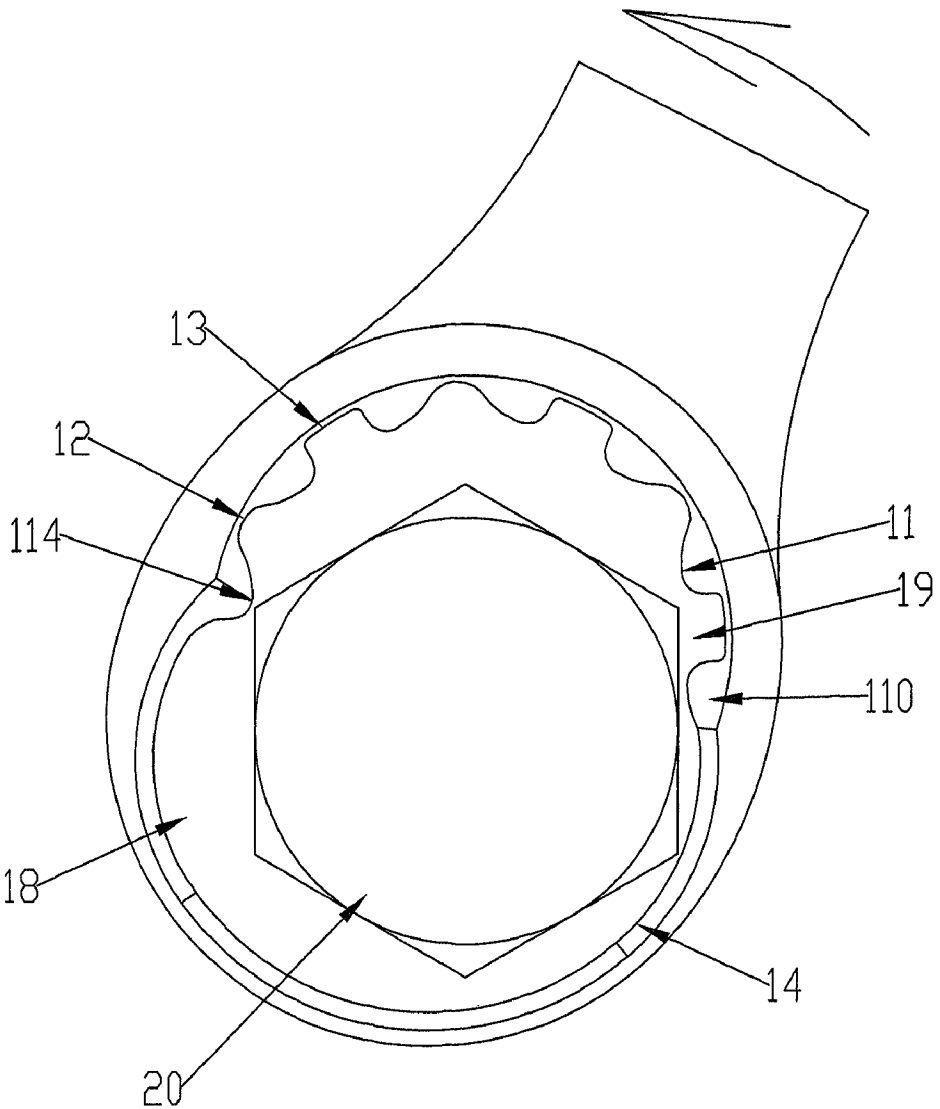
FIG. 6 shows yet another status of the wrench of the present invention rotating in opposite direction while the wrench does not remove from the hexagonal object.

As shown in FIG. 4, when shifting the object 20 to the accommodating hole 18, the driving head 100 can be rotated counter clockwise while the object 20 does not rotate with the wrench. One of the corners of the object 20 is removed from the reception concavity 12 and the sixth second engaging portion 111 (clockwise) moves over the corner of the object 12. The object 20 can move toward the accommodating hole 18. When the wrench continues to rotate counter clockwise, the seventh first engaging portion 110 (clockwise) moves over the corner of the object 12 as shown in FIG. 5. Because the maximum distance "H3" from the third engaging portion 114 to the accommodating hole 18 is larger than a maximum diagonal of the hexagonal object 20, the whole object 20 is disengaged from the engaging hole 19 and located in the accommodating hole 18 as shown in FIG. 6 so that the wrench can freely rotated.

Figure 7:
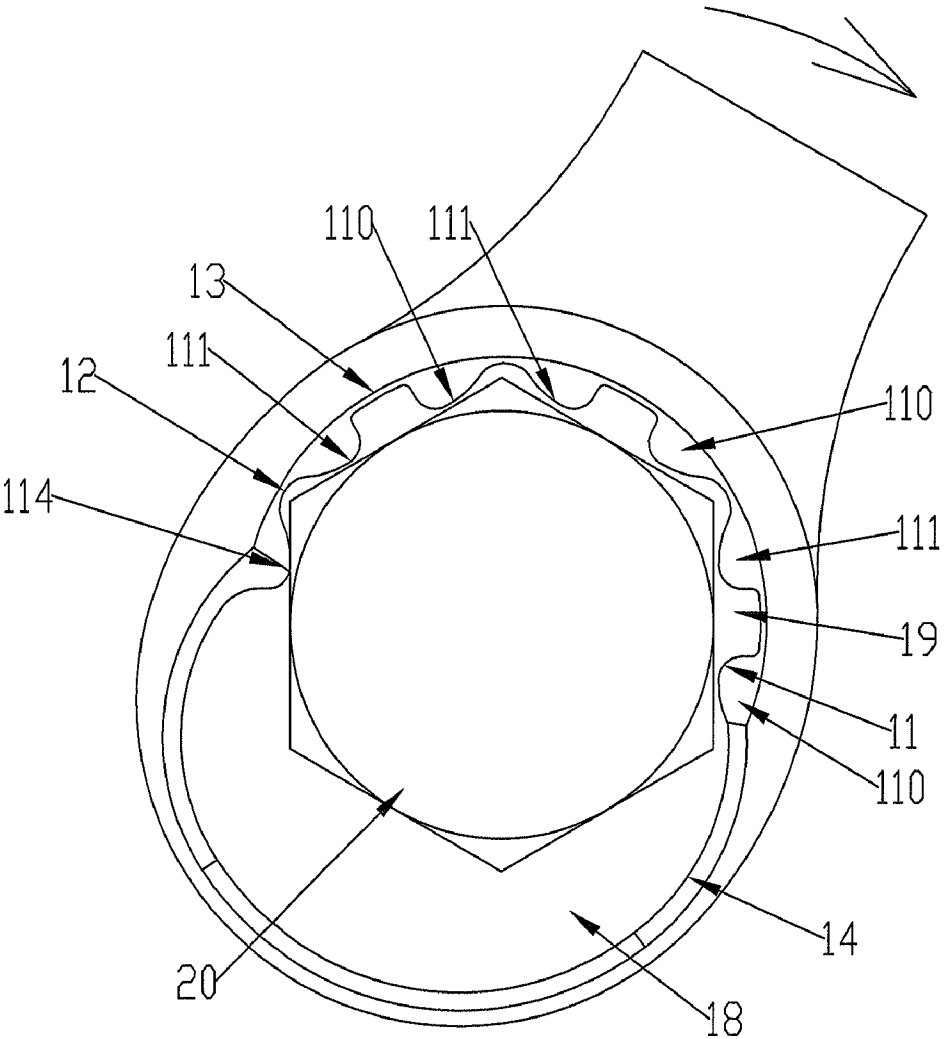
FIG. 7 shows that the wrench of the present invention drives the hexagonal object again.

As shown in FIG. 7, when the wrench is rotated to a proper position, the driving head 100 is moved to mount the object 20 with the engaging hole 19 again, the first, second and third engaging portions 110, 111, 114 are in contact with the four sides of the object 20, the three corners of the object 20 are received in the reception concavities 12. The object 20 is co-rotated with the wrench in clockwise direction.

Figure 8:
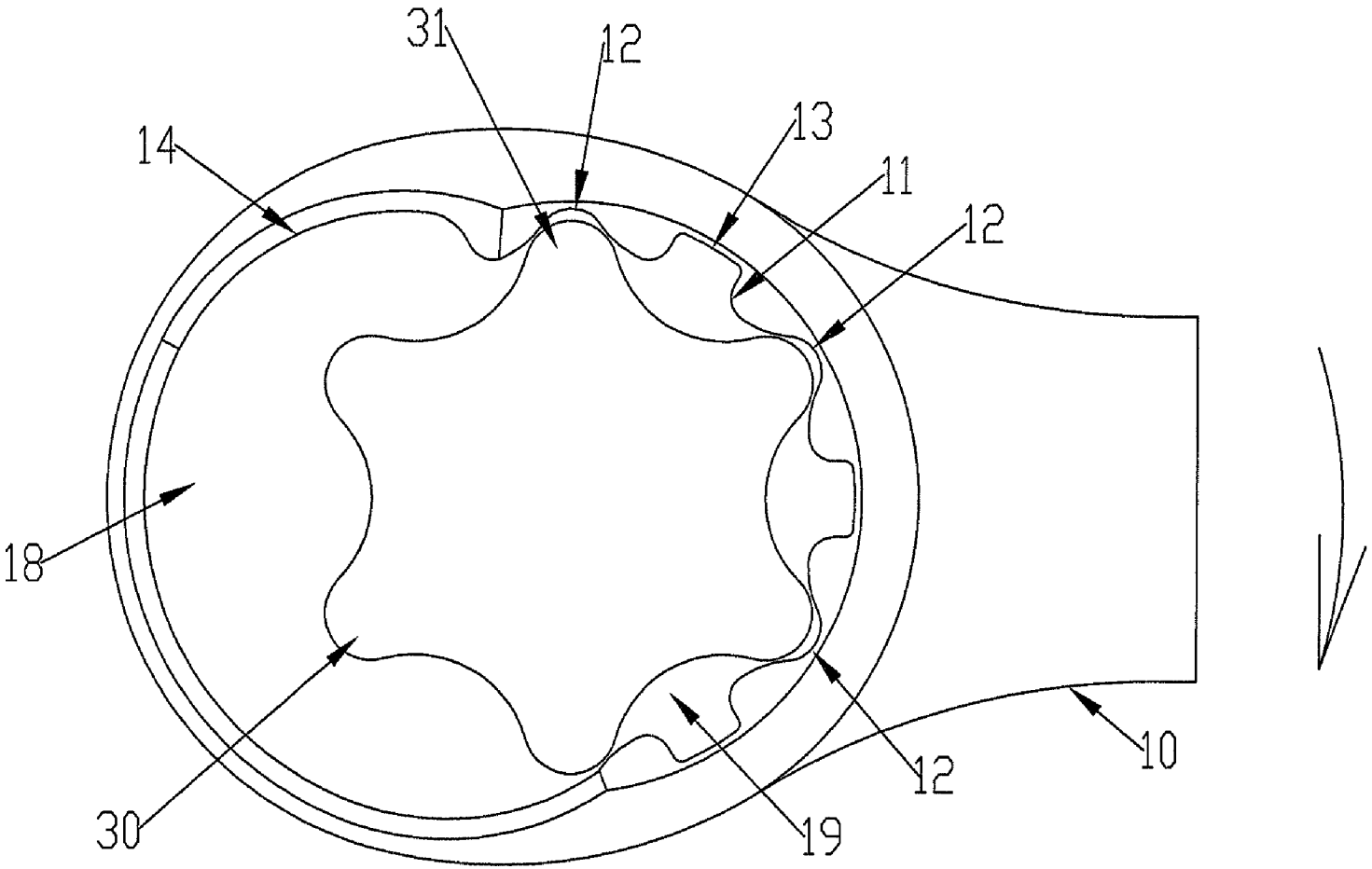
FIG. 8 shows that the wrench of the present invention driving a star-shaped object in one direction.

As shown in FIG. 8 which shows that the object is a star-shaped object 30 and the protrusions 31 of the star-shaped object 30 are received in the three reception concavities 12 so that the object 30 can be rotated while the wrench rotates.

Figure 9:
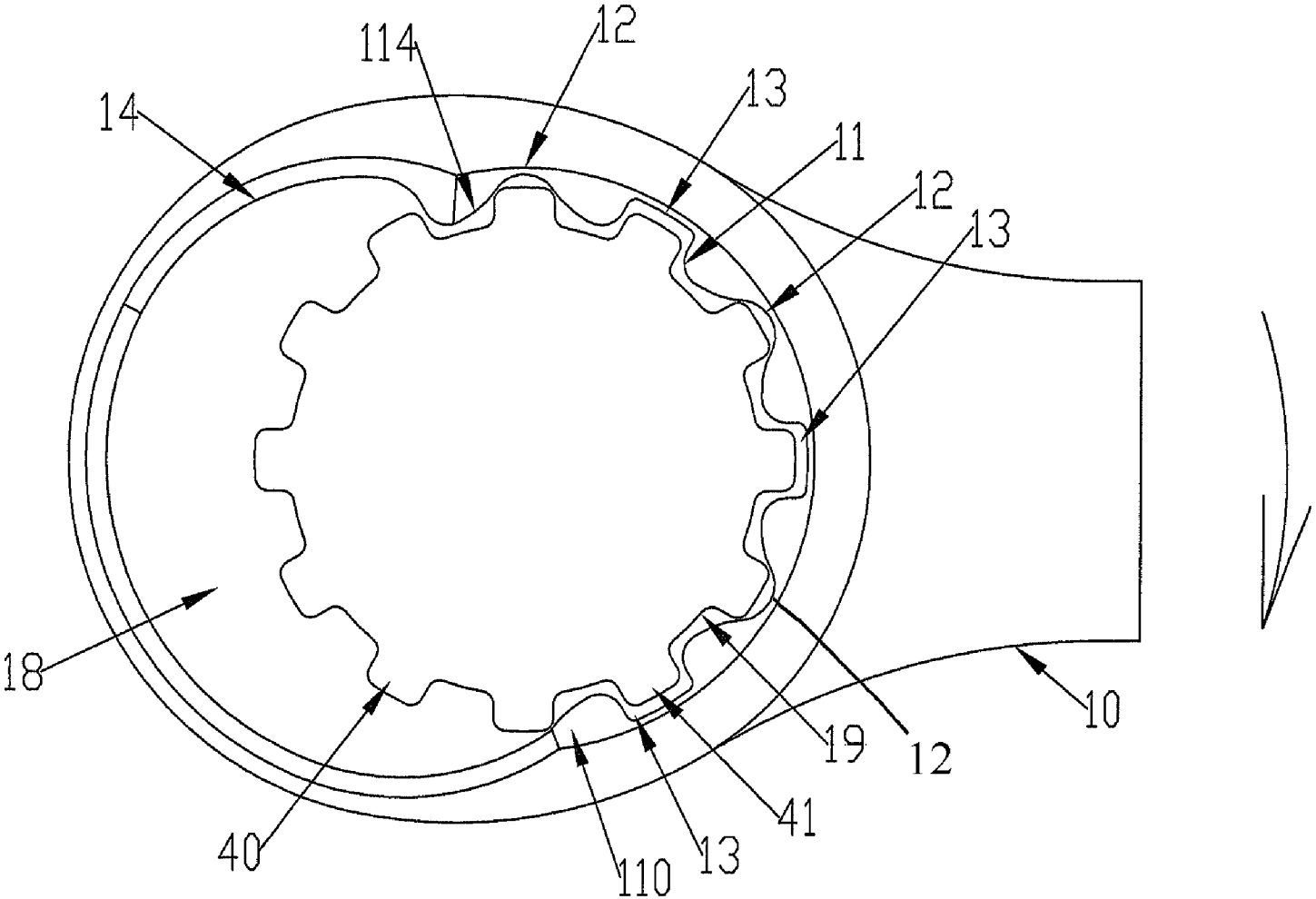
FIG. 9 shows that the wrench of the present invention driving a gear-shaped object in one direction.

As shown in FIG. 9 which shows that the object is a gear-shaped object 40 and three protrusions 41 of the gear-shaped object 40 are received in the three reception concavities 12 and three protrusions 41 are engaged with the recesses 13 so that the object 40 can be rotated while the wrench rotates.

Figure 10:
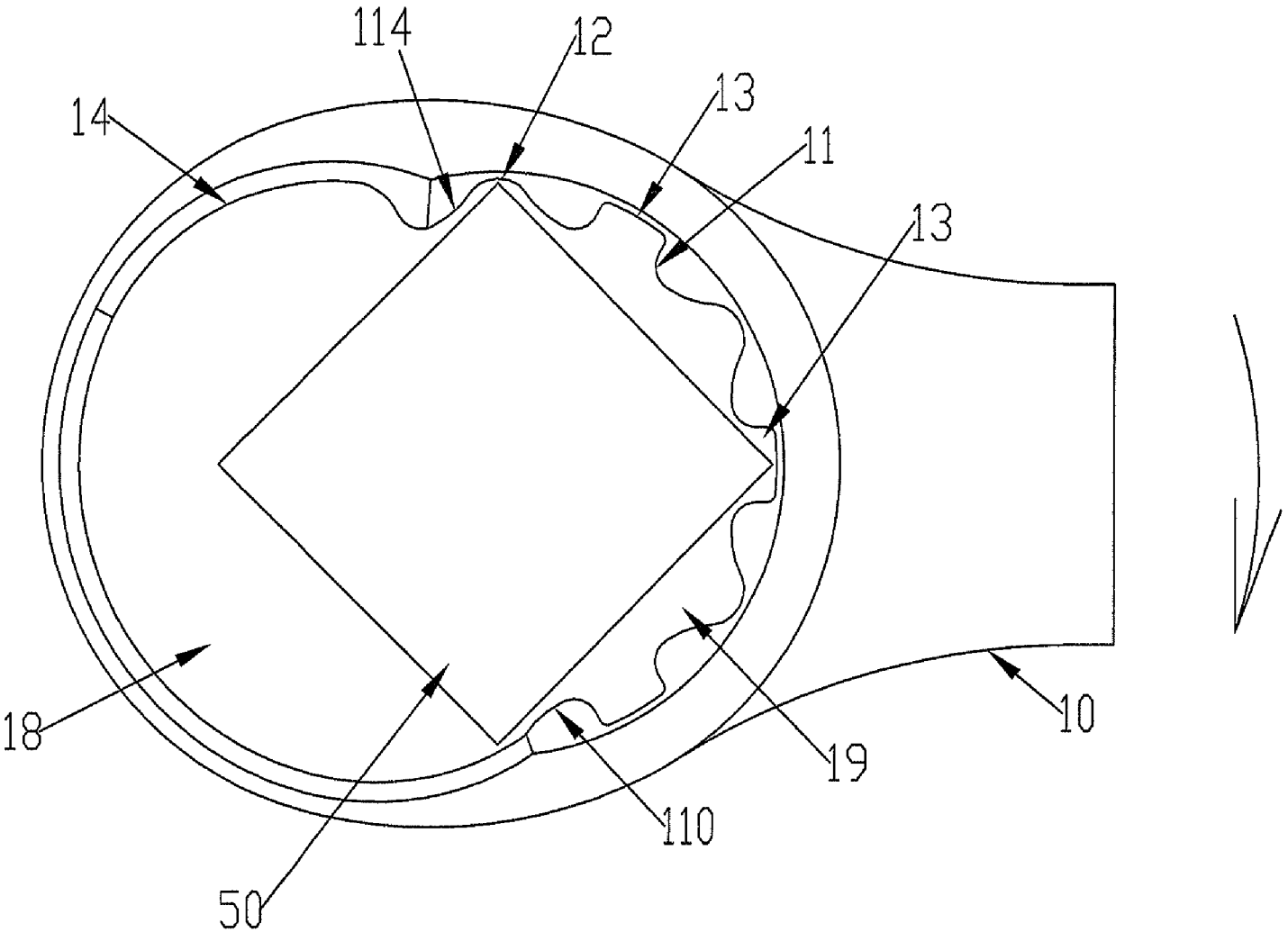
FIG. 10 shows that the wrench of the present invention driving a rectangular object in one direction.

As shown in FIG. 10 which shows that the object is a rectangular object 50 and two corners of the rectangular object 50 are received in the reception concavity 12 and the recess 13. The first engaging protrusion 110 and the third engaging protrusion 114 are in contact with two sides of the object 50.

Figure 11:
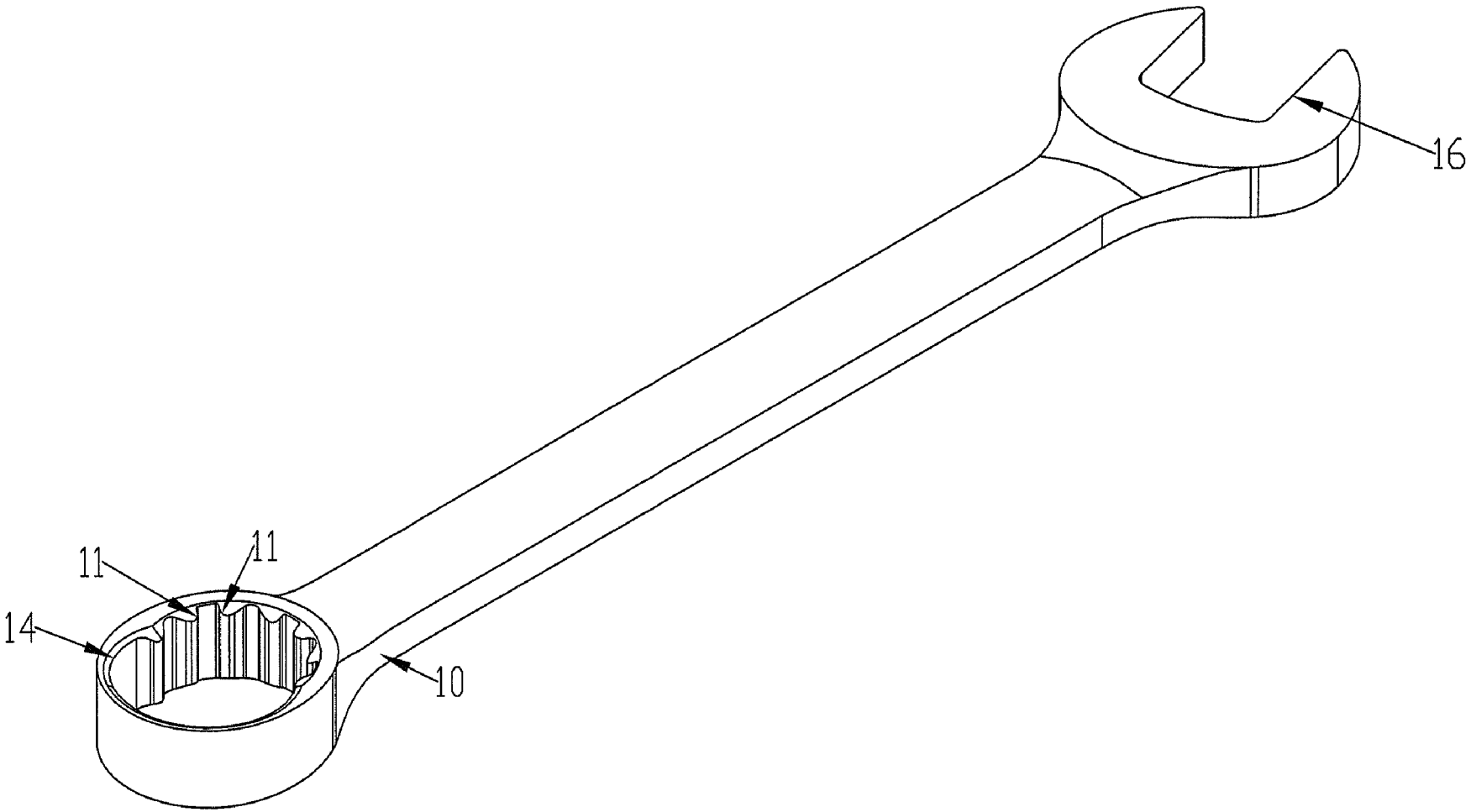
FIG. 11 shows a second embodiment of the wrench of the present invention.

FIG. 11 shows that the second end of the body 10 has an open end 16.

Figure 12:
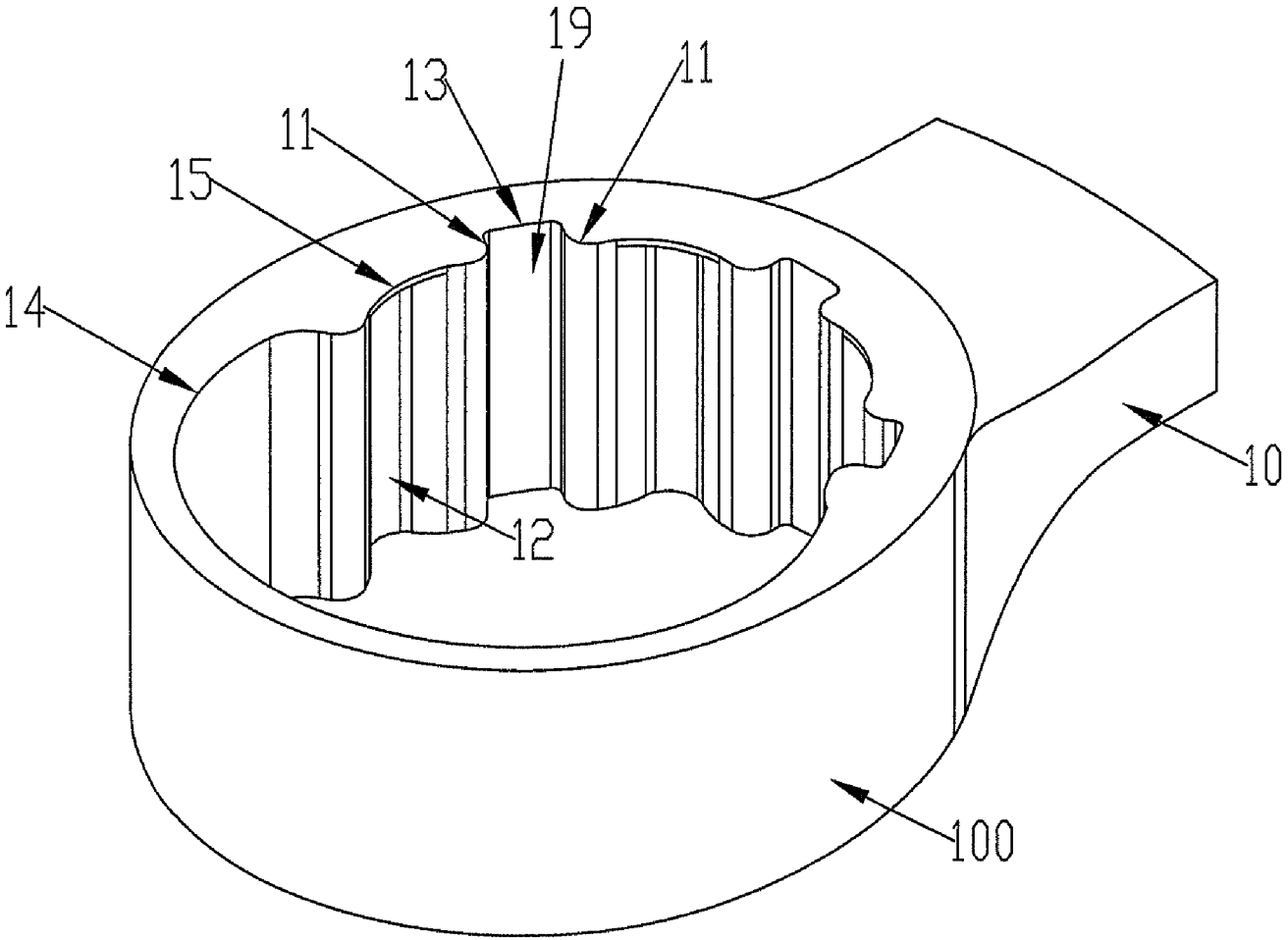
FIG. 12 shows a third embodiment of the wrench of the present invention.
Figure 13:
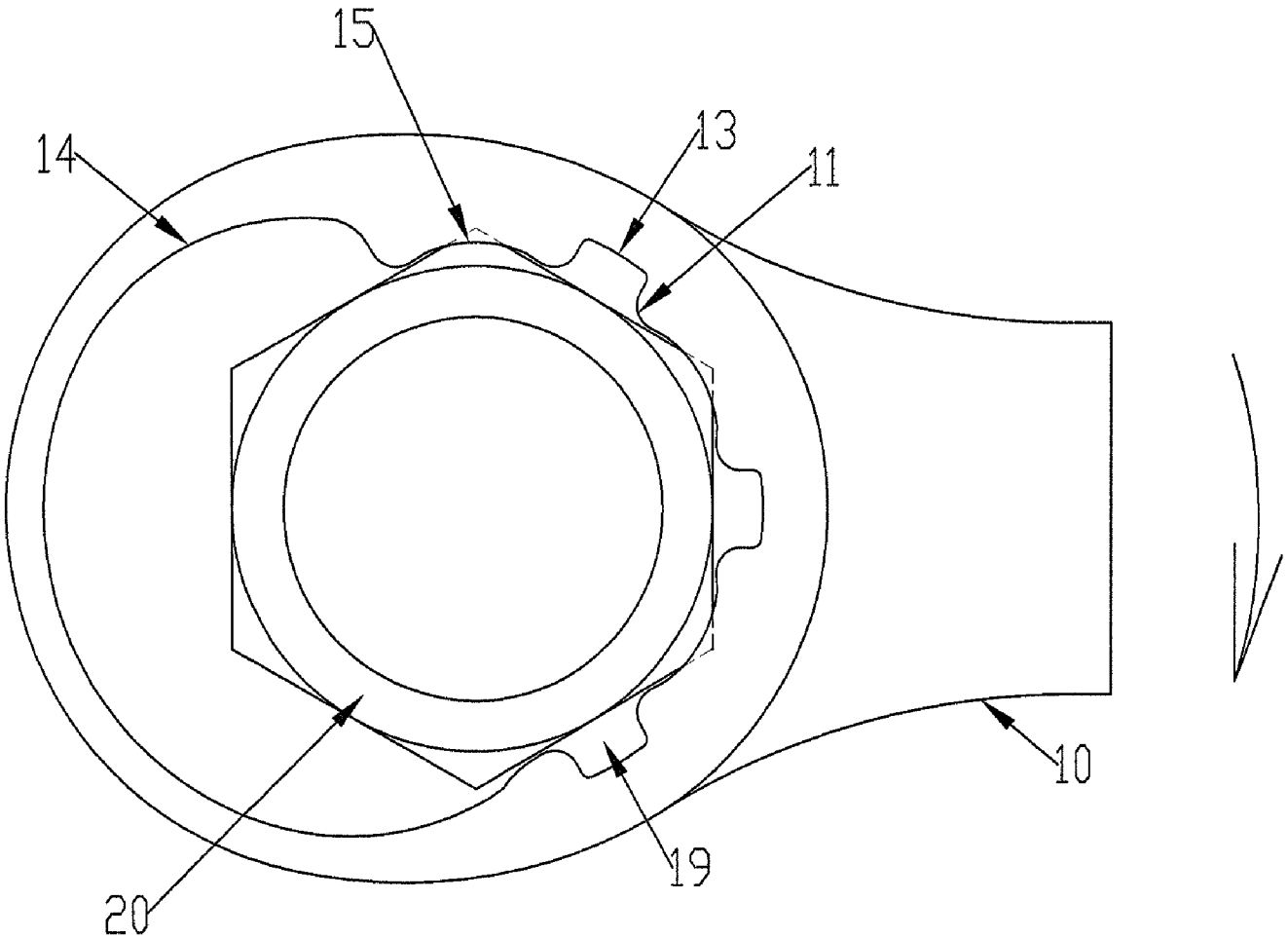
FIG. 13 shows that the wrench in FIG. 12 drives a hexagonal object.

FIGS. 12 and 13 show that each reception concavity 12 includes a contact surface 15 to close an end on an axial direction thereof. When the engaging hole 19 is mounted to the object 20, the three corners of the object 20 are engaged with the reception concavities 12 and restricted by the contact surfaces 15. This prevents the object 20 from disengaging from the driving head 100.

Figure 14:
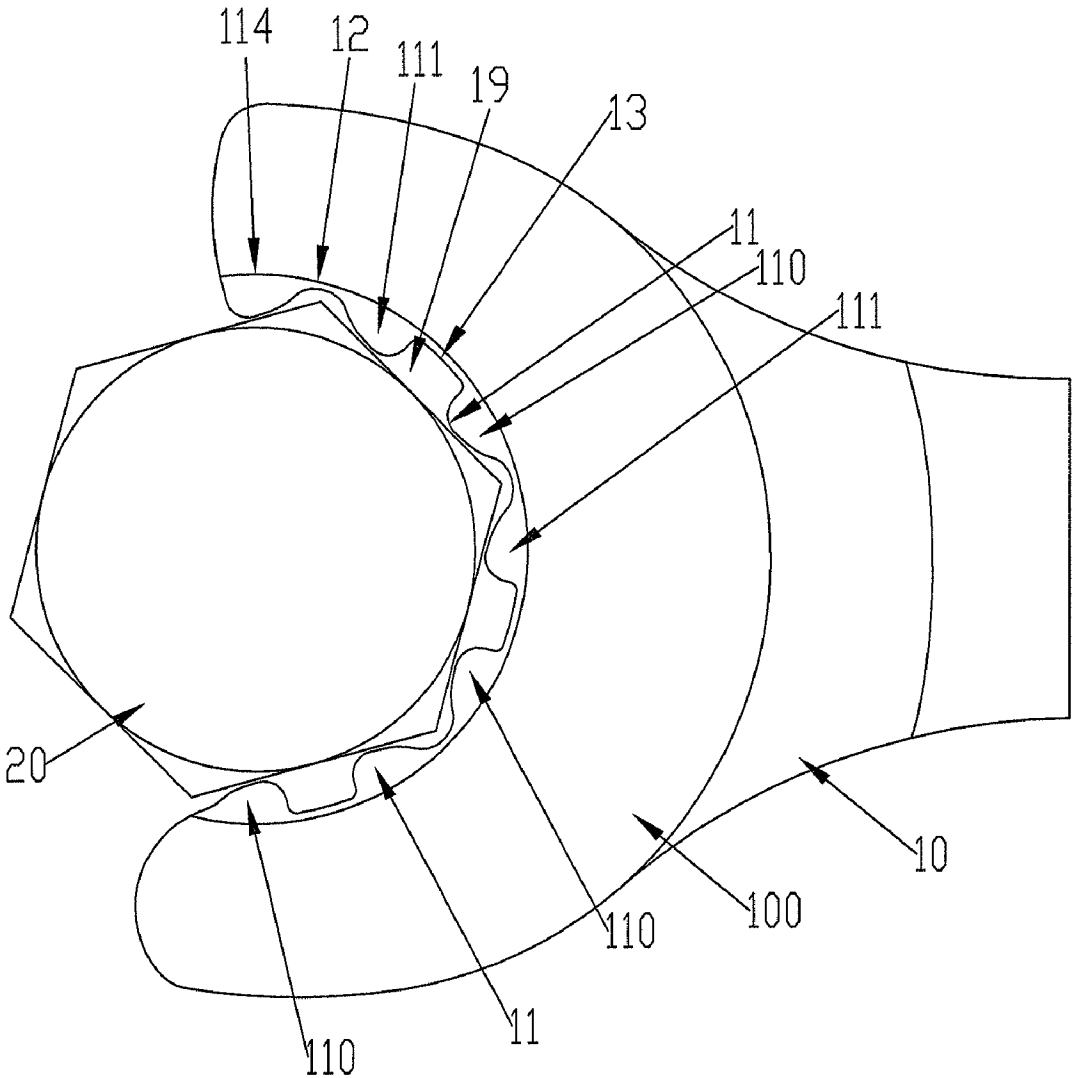
FIG. 14 shows a fourth embodiment of the wrench of the present invention.

FIG. 14 shows a second embodiment of the present invention, wherein the driving head 100 includes a C-shaped engaging hole 19 and an object 20 is engaged with the engaging hole 19. The engaging hole 19 has the same structure as that shown in FIG. 2 and includes three engaging surfaces 11 and three reception concavities 12, three first engaging portions 110, three second engaging portions 111 and a third engaging portion 114.

Figure 15:
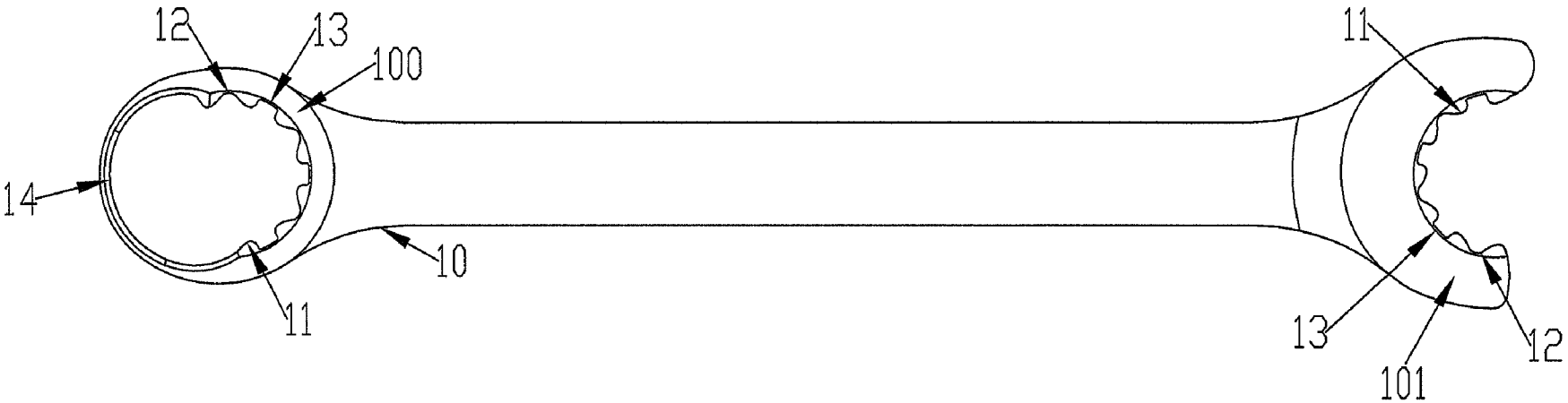
FIG. 15 shows a fifth embodiment of the wrench of the present invention.

FIG. 15 shows the wrench has a driving head 100 the same as that shown in FIG. 2 and the other driving head 101 the same as that shown in FIG. 14.

Figure 16:
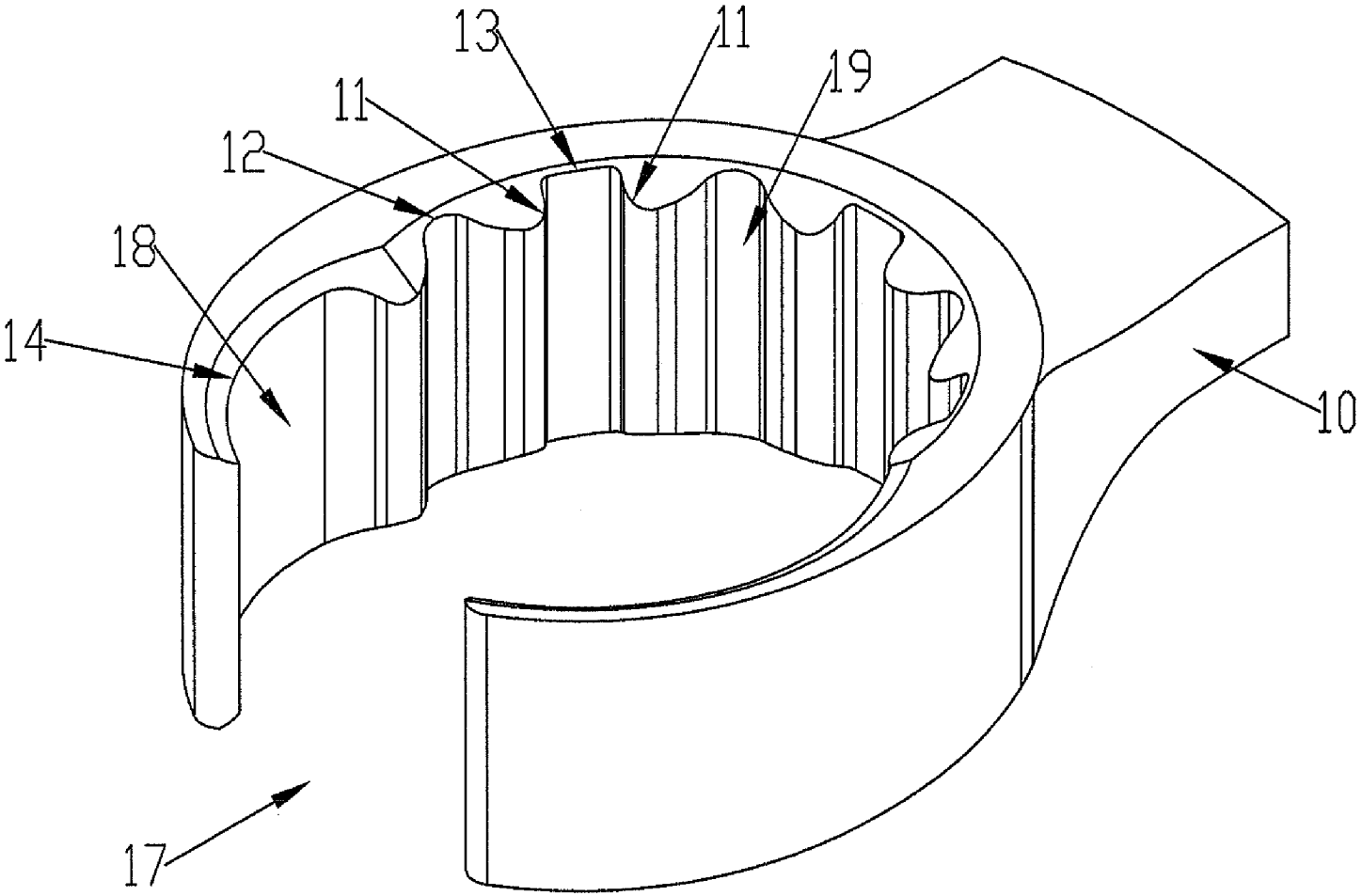
FIG. 16 shows a sixth embodiment of the wrench of the present invention.

FIG. 16 shows that an opening 17 is defined in the accommodating hole 18 so as to form a C-shaped through hole 14.

The wrench of the present invention includes the following features:

(1) As shown in FIGS. 7-10, the reception concavities 12 of the wrench can accommodate the protrusions of hexagonal objects, star-shaped objects and gear-shaped objects, and the recesses 13 can receive protrusions of star-shaped objects and gear-shaped objects. The three recesses 13 and three reception concavities 12 accommodate half of the protrusion of the gear-shaped object.

(2) As shown in FIGS. 2, 8 and 9, the engaging surface 11 has a width "H1", when the "H1" is changed while the sides "A" of a hexagonal object is not changed, the smooth surface 112 and the two sides of the reception concavities 12 are changed so that the accommodation space becomes bigger or smaller. The change allows the wrench to accommodate the tolerance of the protrusions of the star-shaped objects. The engaging surfaces 11 and the recesses 13 can also accommodate the tolerance of the protrusions of the gear-shaped object and the hexagonal objects 20.

(3) As shown in FIGS. 2, 8 and 9, the engaging surface 11 has a recess 13 which includes two parallel insides 131 so that when the distance between the two insides 131 is changed, the space between the two insides 131 accommodates the tolerance of the protrusions 31 of the star-shaped objects 30. Nevertheless, the reception concavities 12 do not need to change and accommodate the tolerance of the star-shaped objects 40.

The wrench can be used for multiple sizes of objects of systems. The hexagonal objects 20 from 4 mm to 36 mm can be cooperated with the hexagonal object 20 of English system and the E-series star-shaped objects 30 and the gear-shaped objects 40. 97% of the objects can be driven by the wrench of the present invention.

(4) As shown in FIGS. 3-7, the engaging hole 19 of the wrench of the present invention includes total of seven engaging portions 110, 111, 114, when shifting the driving head 100 relative to a hexagonal object 20, the driving head 100 does not need to removed from the object 20 axially and simply shifts the driving head 100 aside to accommodate the object 20 within the accommodating hole 18. Then the wrench can be freely rotated to a desired position and re-mounts the object 20 by the engaging hole 19 again.

While we have shown and described the embodiment in accordance with the present invention, it should be clear to those skilled in the art that further embodiments may be made without departing from the scope of the present invention.

What is claimed is:

1. A wrench comprising:

a elongate body having a first end and a second end, a driving head connected on the first end and including a through hole which is composed of an accommodating hole and an engaging hole which communicates with the accommodating hole, the engaging hole including three engaging surfaces and three reception concavities defined in an inner periphery thereof and located about an axis of the engaging hole, the three engaging surfaces located alternatively to the three reception concavities, each engaging surface located on a convex and curved surface extending toward a center of the engaging hole and each reception concavity including two symmetric curved insides, the reception concavities each being adapted to accommodate one of protrusions of a star-shaped nut, a recess defined in a center of each of engaging surfaces and extending parallel to the axis of the engaging hole, each recess located between a first engaging portion and a second engaging portion which is located symmetrically to the first engaging portion, the reception concavity located at the conjunction between the accommodating hole and the engaging hole having one of two insides thereof connected to the second engaging portions next to it, the other insides of the reception concavity located at the conjunction between the accommodating hole and the engaging hole connected with a third engaging portion which has an identical shape as the first engaging portion, each recess including two insides and a bottom located between the two insides, a distance between the two insides adapted to accommodate one of protrusions of a star-shaped nut, a curved surface connected between the first/second engaging portion and the insides of each of the recesses, a smooth surface connected between the first/second engaging portion and each of the reception concavities, a space between the smooth surface and the reception concavity adapted to accommodate one of protrusions of a star-shaped nut, the adjacent first and second engaging portions having a common tangent line and three respective common tangent lines located on three sides of a hexagonal object, a distance defined between a center of an inscribed circle and a center of the accommodating hole, a maximum distance from the third engaging portion to the accommodating hole being larger than a maximum diagonal of the hexagonal object.

2. The wrench as claimed in claim 1, wherein each of the reception concavities is adapted to accommodate a protrusion of a gear-shaped object.

3. The wrench as claimed in claim 1, wherein the two insides of each of the recesses are parallel to each other and a distance between the two parallel insides is adapted to accommodate a protrusion of a gear-shaped object.

4. The wrench as claimed in claim 1, wherein the bottom of each of the recesses is a concaved and curved bottom.

5. The wrench as claimed in claim 1, wherein a rounded corner is defined at a conjunction between each of the two insides and the bottom.

6. The wrench as claimed in claim 1, wherein a smooth surface is connected between the recesses and the first and second engaging portions, the smooth surface is tangent to the first and second engaging portions, the smooth surface is not tangent to the reception concavities.

7. The wrench as claimed in claim 1, wherein a space defined between the smooth surfaces and the reception concavities is adapted to accommodate a protrusion of a gear-shaped object.

8. The wrench as claimed in claim 1, wherein each reception concavity includes a contact surface to close an end on an axial direction thereof.

9. The wrench as claimed in claim 1, wherein an opening is defined in the accommodating hole so as to form a C-shaped through hole.

10. The wrench as claimed in claim 1, wherein the body is a handle.

* * * * *